US011339519B2

(12) United States Patent
Jiang et al.

(10) Patent No.: US 11,339,519 B2
(45) Date of Patent: May 24, 2022

(54) WASHING MACHINE AND STEAM WASHING METHOD THEREOF

(71) Applicant: QINGDAO HAIER DRUM WASHING MACHINE CO., LTD., Qingdao (CN)

(72) Inventors: Yongqiang Jiang, Qingdao (CN); Zhilong Zhao, Qingdao (CN); Xiaojie Pi, Qingdao (CN); Xuewu Hou, Qingdao (CN)

(73) Assignee: QINGDAO HATER DRUM WASHING MACHINE CO., LTD., Qingdao (CN)

( * ) Notice: Subject to any disclaimer, the term of this patent is extended or adjusted under 35 U.S.C. 154(b) by 313 days.

(21) Appl. No.: 16/615,965

(22) PCT Filed: May 10, 2018

(86) PCT No.: PCT/CN2018/086394
§ 371 (c)(1),
(2) Date: Nov. 22, 2019

(87) PCT Pub. No.: WO2018/214749
PCT Pub. Date: Nov. 29, 2018

(65) Prior Publication Data

US 2020/0173093 A1 Jun. 4, 2020

(30) Foreign Application Priority Data

May 23, 2017 (CN) ..... 201710370519.2

(51) Int. Cl.
*D06F 35/00* (2006.01)
*D06F 33/44* (2020.01)
(Continued)

(52) U.S. Cl.
CPC ..... *D06F 35/006* (2013.01); *D06F 33/34* (2020.02); *D06F 33/44* (2020.02); *D06F 34/06* (2020.02);
(Continued)

(58) Field of Classification Search
CPC ..... D06F 33/36; D06F 35/006
See application file for complete search history.

(56) References Cited

U.S. PATENT DOCUMENTS

2008/0289117 A1* 11/2008 Lee ..... D06F 39/008 8/149.1
2014/0208522 A1* 7/2014 Oh ..... D06F 33/36 8/137

FOREIGN PATENT DOCUMENTS

CN 1977078 A 6/2007
CN 103459703 A 12/2013
(Continued)

OTHER PUBLICATIONS

International Search Report dated Aug. 21, 2018 in corresponding International Application No. PCT/CN2018/086394; 6 pages.

*Primary Examiner* — Spencer E. Bell
(74) *Attorney, Agent, or Firm* — Maier & Maier, PLLC

(57) ABSTRACT

A washing machine and a steam washing method. In order to enable the washing machine to meet a user's demand for refined washing and to achieve the object of reducing washing machine costs and energy consumption, the steam washing method includes: receiving an initial washing program of the washing machine; determining whether a steam washing instruction is received; and if not, performing a corresponding initial washing operation according to the initial washing program, and if so, configuring at least one steam washing program based on the initial washing program, where the washing machine can perform the corresponding steam washing operation according to the steam
(Continued)

washing program. The method heats a minimum amount of water each time to generate steam, and determines whether a second heating is performed to generate steam based on the washing effect, so massive heating is avoided if much steam is unnecessary, thus maximizing energy savings.

7 Claims, 2 Drawing Sheets

(51) Int. Cl.

| | |
|---|---|
| ***D06F 33/34*** | (2020.01) |
| ***D06F 105/10*** | (2020.01) |
| ***D06F 33/36*** | (2020.01) |
| ***D06F 105/56*** | (2020.01) |
| ***D06F 105/02*** | (2020.01) |
| ***D06F 103/70*** | (2020.01) |
| ***D06F 105/52*** | (2020.01) |
| ***D06F 34/06*** | (2020.01) |

(52) U.S. Cl.
CPC ..... *D06F 33/36* (2020.02); *D06F 2103/70* (2020.02); *D06F 2105/02* (2020.02); *D06F 2105/10* (2020.02); *D06F 2105/52* (2020.02); *D06F 2105/56* (2020.02)

(56) References Cited

FOREIGN PATENT DOCUMENTS

| | | | |
|---|---|---|---|
| CN | 103966798 | A | 8/2014 |
| CN | 103966800 | A | 8/2014 |
| CN | 104746313 | A | 7/2015 |
| CN | 106245271 | A | 12/2016 |

* cited by examiner

WASHING MACHINE AND STEAM WASHING METHOD THEREOF

FIELD

The present disclosure belongs to the technical field of washing machines, and in particular relates to a washing machine and a steam washing method thereof.

BACKGROUND

With the improvement of people's living conditions, washing machines having a heating function have also been popularized into people's lives. At present, in a washing machine having a heating function, a heater is typically used to heat washing water in a washing tub so that the washing water can reach a temperature required by a set program. Heating of the washing water not only can fully excite activities of active enzymes, but also enables high-temperature sterilization.

With user's higher and higher demands on the washing machine in terms of energy saving and delicate washing of laundries, a washing duration will be reduced and washing and caring requirements will be lowered in some washing machines with the purpose of energy saving and power reduction. Although electrical energy is saved in this manner, the objective of delicate washing cannot be achieved. Some washing machines implements the objective of delicate washing by introducing a steam washing function. However, the steam washing of current washing machines is to use a steam generating device configured in the washing machine to produce steam by heating. That is, when the user selects the steam washing, the steam generating device will be triggered to generate steam by heating, followed by a normal washing, rinsing and spinning process. Due to the need to configure a separate steam generating device, not only the cost is increased, but also the energy consumption of the washing machine is increased.

In order to implement both the functions of heating and steam washing of the washing machine, it is also feasible to combine the steam generating device and the heater of the washing machine into one device. For example, a heating device of a washing machine disclosed in the Chinese patent publication No. CN104746313A is capable of achieving the purpose of heating washing water in a washing tub. With a chamber disposed in a casing, the heating device heats water in the chamber to a state in which steam is generated, and then the steam is sprayed into the washing tub from an outlet. This heating device is essentially equivalent to integrating a separately configured steam generating device into the heater of the washing machine. Therefore, in essence, the washing principle of spraying steam into the washing tub by the steam generating device is applied.

On view of the above, there is a need in the art for a new method to solve the above problems.

SUMMARY

In order to solve the above problems in the related art, that is, to enable the washing machine not only to meet the need of the user for delicate washing, but also to achieve energy saving and consumption reduction, a steam washing method of a washing machine is provided by the present disclosure, the steam washing method including the steps of: receiving an initial washing program of the washing machine; determining whether a steam washing instruction is received; if no steam washing instruction is received, performing a corresponding initial washing operation according to the initial washing program; and if the steam washing instruction is received, configuring at least one steam washing program based on the initial washing program; wherein the washing machine is capable of performing a corresponding steam washing operation according to the steam washing program.

In a preferred embodiment of the steam washing method described above, the at least one steam washing program includes performing a first-time steam washing operation according to the steam washing program before the initial washing operation.

In a preferred embodiment of the steam washing method described above, the step of performing the first-time steam washing operation according to the steam washing program specifically includes: injecting a first set amount of washing water into the washing machine; heating the first set amount of washing water to a first set temperature to so that the washing water generates steam; and operating the washing machine for steam washing for a first preset duration.

In a preferred embodiment of the steam washing method described above, the steam washing method further includes performing the initial washing operation after the first-time steam washing operation is performed.

In a preferred embodiment of the steam washing method described above, the at least one steam washing program further includes performing a second-time steam washing operation according to the steam washing program after the initial washing operation.

In a preferred embodiment of the steam washing method described above, the step of performing the second-time steam washing operation according to the steam washing program specifically includes: determining whether a duration of the initial washing operation meets a requirement of performing the second-time steam washing operation; and performing the second-time steam washing operation according to the steam washing program, in a case that the duration of the initial washing operation meets the requirement of performing the second-time steam washing operation.

In a preferred embodiment of the steam washing method described above, the step of determining whether the duration of the initial washing operation meets the requirement of performing the second-time steam washing operation specifically includes: determining whether the duration of the initial washing operation is greater than a set threshold; and determining that the duration of the initial washing operation meets the requirement of performing the second-time steam washing operation, in a case that the duration of the initial washing operation is greater than the set threshold.

In a preferred embodiment of the steam washing method described above, the step of performing the second-time steam washing operation according to the steam washing program specifically includes: making the washing water in the washing machine reach a second set amount; heating the second set amount of washing water to a second set temperature so that the washing water generates steam; and operating the washing machine for steam washing for a second preset duration.

In a preferred embodiment of the steam washing method described above, that the washing machine is capable of performing the corresponding steam washing operation according to the steam washing program specifically means that the washing machine is capable of performing the steam washing operation according to a rotational speed and an on/off ratio set by the steam washing program.

The present disclosure further provides a washing machine having a heating portion capable of heating washing water, wherein the washing machine further includes a control unit configured to perform the steam washing method described above.

In the steam washing method of the present disclosure, the steam washing of the washing machine may be achieved by using a heater on the washing machine. Moreover, the steam washing program is configured according to the initial washing program, so that it can meet different caring requirements for different laundries, and the most reasonable and the best-quality caring of laundries can be achieved. Specifically, in the steam washing process, a small amount of washing water is injected first, so that during the process of heating the washing water, the heater consumes as little energy as possible to heat the washing water to generate steam. Then, the initial washing program is entered, and if the washing and caring standard required for the laundry is reached after the initial washing operation is performed, the method ends directly. Otherwise, the second-time steam washing operation is performed only when the requirement of performing the second-time steam washing operation is met. In the event of adopting the above technical solution and using the method of the present disclosure, a minimum amount of water is heated each time to generate steam, and then it is determined whether to perform a second-time heating to generate steam according to the washing effect, thereby avoiding a consumption of massive water for heating and steam generation when a large amount of steam is not required for the laundry, thus maximizing energy saving.

DETAILED DESCRIPTION

Preferred embodiments of the present disclosure will be described below with reference to the accompanying drawings. It should be appreciated by those skilled in the art that these embodiments only serve to explain the technical principles of the present disclosure, and are not intended to limit the scope of protection of the present disclosure.

A washing machine having a heating function (such as heating by a heater) is a washing machine that is capable of heating washing water in a washing tub so that the washing water can reach a suitable temperature or a set temperature. The present disclosure aims to provide a simple and effective method for realizing steam washing, which is applicable to a washing machine having a heating function, and by which the steam washing function of the washing machine can be realized without changing the structure of the washing machine.

It is emphasized that the heater having the heating function of the present disclosure is essentially different from the heating device of the washing machine mentioned in the background art. Specifically, the present disclosure merely reserves the heating function of the washing machine completely, and does not have a steam generating device or a structure equivalent to that of a steam generating device integrated on the heater. Instead, through a corresponding control strategy, the user implements the dual functions of heating and steam washing of the washing machine by setting a program of the control strategy. The steam washing method of the present disclosure will be described below in detail with reference to FIG. 1. The heater may be an electric heater or a magnetic heater. It should be noted that in addition to the use of the heater, the washing machine may also realize heating of the washing water by configuring any other component or module capable of heating.

Figure 1:
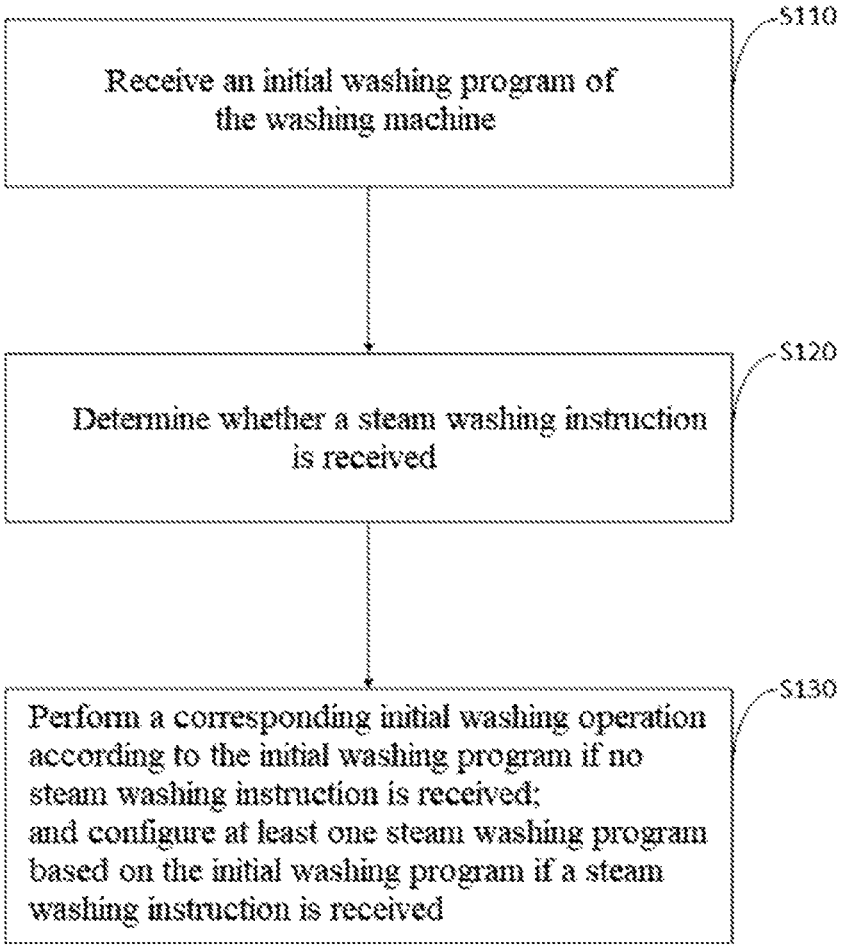
FIG. 1 is a schematic flow chart of a steam washing method of a washing machine according to the present disclosure.

FIG. 1 is a schematic flow chart of a steam washing method of a washing machine according to the present disclosure. As shown in FIG. 1, the steam washing method of the present disclosure includes the following steps: S110, receiving an initial washing program of the washing machine; S120, determining whether a steam washing instruction is received; S130, if no steam washing instruction is received, performing a corresponding initial washing operation according to the initial washing program; and if the steam washing instruction is received, configuring at least one steam washing program based on the initial washing program; wherein the washing machine is capable of performing a corresponding steam washing operation according to the steam washing program.

It should be noted that the initial washing program is a normal washing program (also referred to as a standard washing program), such as washing, rinsing, and spinning the laundries under the premise of sufficient water supply. Preferably, after the washing machine is activated, the user may set different initial washing programs for different laundries. The washing machine may initiate feedback of the steam washing of the laundries, according to steam washing instruction as provided. For example, a function button for steam washing is disposed on an operation panel of the washing machine. After the initial washing program is set, if the user does not press the function button for steam washing on the operation panel, it indicates that the steam washing function is not selected, and the washing machine implements washing directly according to the initial washing program. If the user presses the function button for steam washing on the operation panel, it indicates that the steam washing function is selected. In this situation, before the initial washing program is executed, a corresponding steam washing program is executed first according to the steam washing instruction. For example, for different initial washing programs, corresponding steam washing programs are configured. The steam washing programs are mainly configured to determine operating parameters and start and stop time of the steam washing. In this way, in the process of steam washing, different caring modes may be selected for different laundries, and the most reasonable and the best-quality caring of laundries can be achieved. Since the washing water in the washing tub is heated by the heater of the washing machine to generate steam during the steam washing, a separate steam generating device is omitted. On this basis, the step S130 in the steam washing method of the present disclosure will be described in detail below.

In step S130, the steam washing program includes: performing a first-time steam washing operation according to the steam washing program before the initial washing operation. Specifically, if the user selects the steam washing function, the first-time steam washing operation is performed based on the initial washing program as follows: first, the first set amount of washing water is injected into the washing machine; then, the first set amount of washing water is heated to a first set temperature interval so that the washing water generates steam; and then the washing machine is operated for steam washing for a first preset duration. During the operation of the steam washing, the washing is carried out according to a rotational speed and an on/off ratio set by the steam washing program. The first preset duration may be set according to a specific situation, such as an arbitrary value between 3 and 5 minutes, for ensuring the washing effect of the steam washing and achieving sterilization and full removal of stains. Of course, in order to achieve a better washing and caring effect, the first-time steam washing operation may also be divided into a plurality of sub-stages, and the parameters of individual sub-stages may also be different. The washing and caring effect of steam washing is further improved by setting different parameters for different sub-stages.

It should be noted that the "first set amount" of washing water mentioned above means that a small amount of water is injected into the washing machine. For example, the first set amount is an arbitrary value between ⅕ and ¼ of the maximum water level of washing water required by the initial washing program. In this way, the water in the washing tub can be heated more easily by the heater to generate steam. In this embodiment, after the steam washing is selected, the first set amount of washing water is injected first, and then heating is performed until a temperature at which steam can be generated is reached. At this point, since the amount of water in the washing tub is relatively small, it is only necessary to heat the washing water to a first set temperature (for example, about 50° C. to 60° C.) to generate steam. In this way, the steam washing function of the washing machine can be realized without damaging the laundries, and the energy consumption of the washing machine required for the generation of steam is also saved.

In step S130, the steam washing program further includes: performing a second-time steam washing operation according to the steam washing program after the initial washing operation. Specifically, after the first-time steam washing operation is performed, the initial washing operation is performed, and if the washing and caring standard required for the laundries is reached after the initial washing operation is performed, the method ends directly. Otherwise, it is determined whether the duration of the initial washing operation meets a requirement of performing the second-time steam washing operation, and the second-time steam washing operation is performed only the duration of the initial washing operation meets the requirement of performing the second-time steam washing operation. The manner of determining whether the duration of the initial washing operation meets the requirement of performing the second-time steam washing operation may be: if the duration of the initial washing operation is greater than a set threshold, it indicates that the washing and caring standard required for the laundries is not reached, and then the second-time steam washing operation is performed. That is to say, whether the washing and caring standard required for the laundries is reached can be determined by the washing machine according to the washing duration of the initial washing program, and it is further determined whether it is necessary to perform the second-time steam washing operation. The threshold may be set according to the specific situation.

The step of performing the second-time steam washing operation is: injecting washing water into the washing machine so that the washing water in the washing machine reaches a second set amount; heating the second set amount of washing water to a second set temperature so that the washing water generates steam; and then operating the washing machine for steam washing for a second preset duration. Herein, the "second set amount" of washing water refers to the amount of water after a small amount of water is further injected into the washing machine in addition to the first set amount. The second set amount of washing water may be an arbitrary value between ⅓ and ½ of the amount of water required in the initial washing program. At this point, since the amount of water in the washing tub is still small, it is only necessary to heat the washing water to a second set temperature (for example, about 50° C.-60° C.) to generate steam. The second set temperature may be the same as or different from the first set temperature.

In the steam washing program configured as described above, a certain type of laundry as concerned is generally a laundry having a certain high-temperature resistant material and having a steam washing requirement. Moreover, since the initial washing program is set according to the type of the laundry, whereas the configuration of the steam washing program is formed based on the initial washing program, the steam washing program formed after the configuration can achieve the most reasonable and the best-quality caring for different laundries. Herein, the specific types of laundries will not be described in this embodiment.

After the process of two times of steam generation, the washing machine enters the initial washing program, and a series of washing stages such as subsequent washing, rinsing, spinning and the like are performed according to the initial washing program so that the entire washing process of the laundries is finally completed. In the present embodiment, after the two-time steam washing process, the steam can sufficiently penetrate into the laundries in a staged manner to achieve the effect of sterilization and full removal of stains. Those skilled in the art may also set three or more steam washing processes according to actual situation to obtain a better washing effect.

In summary, in the event of adopting the above technical solution and using the method of the present disclosure, a minimum amount of water is heated each time to generate steam, and then it is determined whether to perform a second-time heating to generate steam according to the washing effect, thereby avoiding a consumption of massive water for heating and steam generation when a large amount of steam is not required for the laundries, thus maximizing energy saving.

A specific embodiment of a steam washing method of the present disclosure will be described below with reference to FIG. 2.

Figure 2:
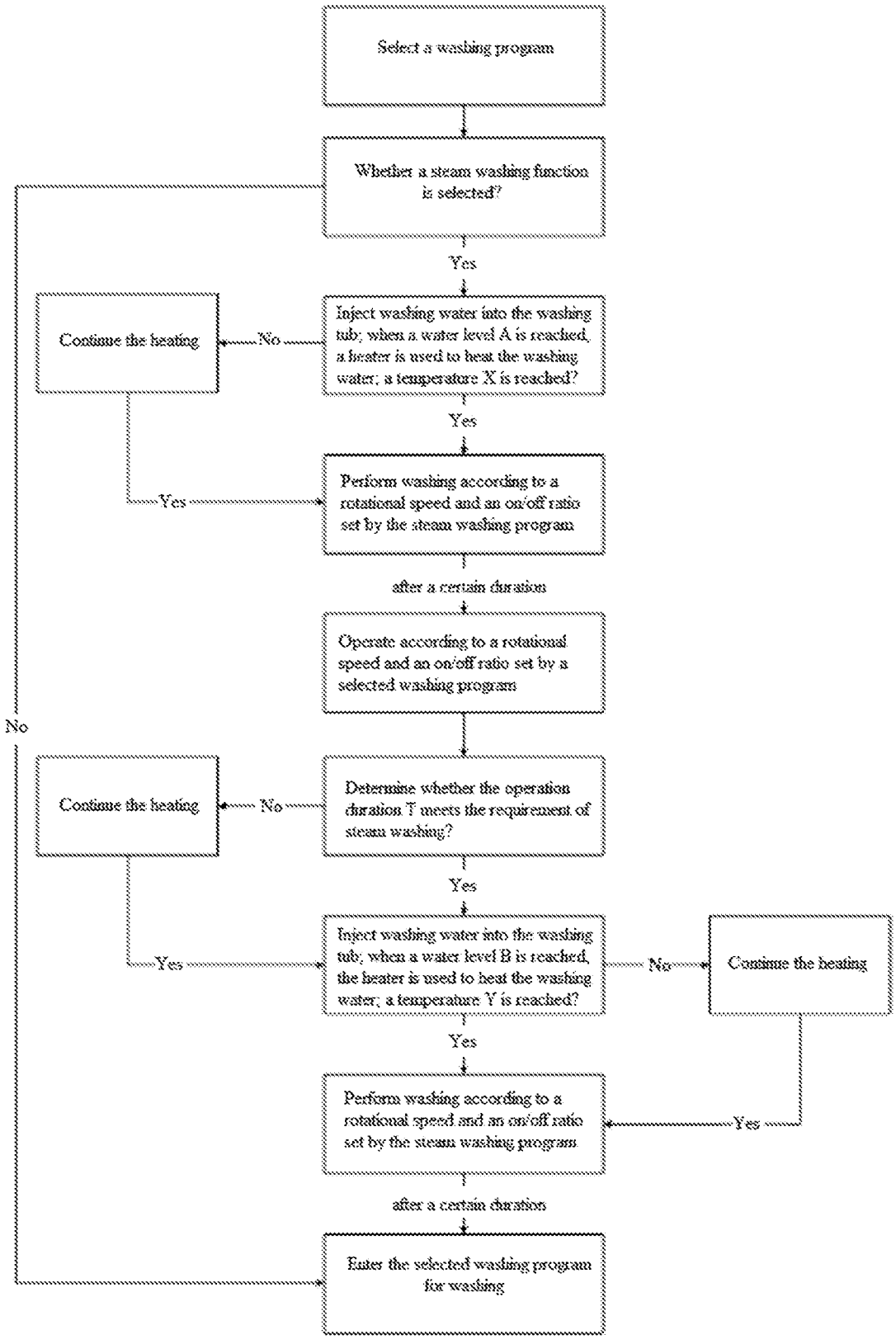
FIG. 2 is a schematic flow chart of a specific embodiment of a steam washing method of a washing machine according to the present disclosure.

As shown in FIG. 2, a washing program is selected first, and it is determined whether a steam washing function is selected; if not, the process directly enters the selected standard washing program; and if yes, washing water is injected into the washing tub; when a water level A is reached, the heater is used to heat the washing water, and it is determined whether a temperature X (X is a temperature at which steam can be generated by the washing water at the water level A) is reached; if yes, washing is performed according to a rotational speed and an on/off ratio set by the steam washing program; if not, the heating is continued until the temperature X is reached, and then washing is performed according to the rotational speed and on/off ratio set by the steam washing program. After being operated for a certain duration (such as 5 minutes), the washing machine is operated according to the rotational speed and on/off ratio set by the selected standard washing program, and it is determined whether the operation duration T (such as 3-5 minutes) meets the requirement of performing a steam washing again. Specifically, the standard washing program is capable of determining whether the washing and caring standard required for the laundries is reached by detecting a state of related parameters (such as the cleanliness of the washing water), and the method directly ends when the washing and caring standard of the laundries is reached. When the washing duration T meets the requirement of performing the second-time steam washing operation (i.e., the washing and caring standard required for the laundries is not reached), the second-time steam washing operation is performed. For example, the washing water can be injected to reach a water level B, and it is determined whether a temperature Y (Y is a temperature at which steam can be generated by the washing water at the water level B) is reached after heating; if not, the washing is continued until the duration T meets the requirement (i.e., the laundries are still not washed clean after the washing machine is operated for the duration T), the washing water is injected to reach the water level B, and it is determined whether the temperature Y is reached after heating; if the washing water is heated to the temperature Y, the washing is performed according to the rotational speed and on/off ratio set by the steam washing program; and if the washing water is not heated to the temperature Y, the heating is continued until the temperature Y is reached; then, the washing is performed according to the rotational speed and on/off ratio set by the steam washing program. After the washing machine is operated for a certain duration (such as 5 minutes), if it is still required to enter the selected standard washing program, then the selected standard washing program is entered for subsequent operations such as washing, rinsing, spinning and the like until the entire washing process is completed. Since a minimum amount of water is heated each time to generate steam, and then it is determined whether to perform a second-time heating to generate steam according to the washing effect, a consumption of massive water for heating and steam generation is avoided when a large amount of steam is not required for the laundry, thus maximizing energy saving.

Further, the present disclosure also provides a washing machine having a heating portion capable of heating washing water, wherein the washing machine further includes a control unit configured to perform the steam washing method described above.

It should be noted that the control unit may be provided as a functional module of the washing machine, or may be configured as a dedicated module; it may be integrated with other devices or apparatuses in terms of physical form, or may be separately provided. The changes and adjustments in these aspects will not deviate from the basic principle of the present disclosure, and therefore are intended to fall within the scope of protection of the present disclosure.

Heretofore, the technical solutions of the present disclosure have been described in conjunction with the preferred embodiments shown in the drawings, but it is obvious to those skilled in the art that the scope of protection of the present disclosure is obviously not limited to these specific embodiments. Those skilled in the art can make equivalent changes or replacements to the related technical features without departing from the principle of the present disclosure. The technical solutions after the modification or replacement will fall within the scope of protection of the present disclosure.

What is claimed is:

1. A washing method of a washing machine, comprising the steps of:

receiving an initial washing program of the washing machine;

determining whether a steam washing instruction is received;

when no steam washing instruction is received, performing a corresponding initial washing operation according to the initial washing program; and when the steam washing instruction is received, configuring at least one steam-washing program based on the initial washing program and performing a first-time steam washing operation according to the steam washing program before the initial washing operation;

wherein the washing machine is capable of performing a corresponding steam washing operation according to the steam washing program;

wherein the at least one steam washing program further comprises performing a second-time steam washing operation according to the steam washing program after the initial washing operation; and wherein the step of performing the second-time steam washing operation according to the steam washing program comprises:

determining whether a duration of the initial washing operation meets a requirement of performing the second-time steam washing operation; and performing the second-time steam washing operation according to the steam washing program, in a case that the duration of the initial washing operation meets the requirement of performing the second-time steam washing operation.

2. The washing method according to claim 1, wherein the step of performing the first-time steam washing operation according to the steam washing program comprises:

injecting a first set amount of washing water into the washing machine;

heating the first set amount of washing water to a first set temperature so that the washing water generates steam; and operating the washing machine for steam washing for a first preset duration.

3. The washing method according to claim 1, wherein the steam washing method further comprises performing the initial washing operation after the first-time steam washing operation is performed.

4. The washing method according to claim 1, wherein the step of determining whether the duration of the initial washing operation meets the requirement of performing the second-time steam washing operation specifically comprises:

determining whether the duration of the initial washing operation is greater than a set threshold; and determining that the duration of the initial washing operation meets the requirement of performing the second-time steam washing operation, in a case that the duration of the initial washing operation is greater than the set threshold.

5. The washing method according to claim 1, wherein the step of performing the second-time steam washing operation according to the steam washing program specifically comprises:

making the washing water in the washing machine reach a second set amount;

heating the second set amount of washing water to a second set temperature so that the washing water generates steam; and operating the washing machine for steam washing for a second preset duration.

6. The washing method according to claim 1, wherein the washing machine is capable of performing the steam washing operation according to a rotational speed and an on/off ratio set by the steam washing program.

7. A washing machine having a heating portion capable of heating washing water, wherein the washing machine further comprises a control unit configured to perform the washing method according to claim 1.

* * * * *